US009908600B2

(12) United States Patent
Hawkins

(10) Patent No.: US 9,908,600 B2
(45) Date of Patent: Mar. 6, 2018

(54) PROPELLER INCLUDING A DISCRETE BLADE EDGE COVER MEMBER

(71) Applicant: Russel Ian Hawkins, Johannesburg (ZA)

(72) Inventor: Russel Ian Hawkins, Johannesburg (ZA)

( * ) Notice: Subject to any disclaimer, the term of this patent is extended or adjusted under 35 U.S.C. 154(b) by 280 days.

(21) Appl. No.: 14/419,145

(22) PCT Filed: Jul. 31, 2013

(86) PCT No.: PCT/IB2013/056278
§ 371 (c)(1),
(2) Date: Feb. 2, 2015

(87) PCT Pub. No.: WO2014/020548
PCT Pub. Date: Feb. 6, 2014

(65) Prior Publication Data

US 2015/0191233 A1 Jul. 9, 2015

(30) Foreign Application Priority Data

Jul. 31, 2012 (ZA) ..... 2012/05753

(51) Int. Cl.

| | |
|---|---|
| ***B63H 5/16*** | (2006.01) |
| ***B63H 1/26*** | (2006.01) |
| ***F01D 5/14*** | (2006.01) |
| ***F01D 5/28*** | (2006.01) |

(52) U.S. Cl.
CPC ..... *B63H 1/26* (2013.01); *B63H 5/16* (2013.01); *B63H 5/165* (2013.01); *F01D 5/147* (2013.01); *F01D 5/28* (2013.01)

(58) Field of Classification Search
CPC . F05D 2240/303; F05D 2230/90; B63H 1/26; B63H 5/16; B63H 5/165; Y10T 29/49337
USPC ..... 416/224, 241 A; 440/71
See application file for complete search history.

(56) References Cited

U.S. PATENT DOCUMENTS

| | | | | |
|---|---|---|---|---|
| 1,531,967 A | | 3/1925 | Macmillan | |
| 2,482,936 A | | 9/1949 | Renoux | |
| 4,738,594 A | * | 4/1988 | Sato | F04D 29/388 416/213 A |
| 5,044,884 A | * | 9/1991 | Thibault | B63H 1/16 416/189 |
| 5,165,859 A | * | 11/1992 | Monroe | F04D 29/289 244/134 D |
| 5,782,607 A | | 7/1998 | Smith et al. | |

(Continued)

FOREIGN PATENT DOCUMENTS

EP 0077931 A2 5/1983

*Primary Examiner* — Matthew W Jellett
(74) *Attorney, Agent, or Firm* — The Webb Law Firm

(57) ABSTRACT

THIS invention relates to a propeller and more particularly but not exclusively, to a propeller for use with inboard and outboard boat engines. The propeller includes a hub and a plurality of blades extending radially outwardly from the hub, wherein each blade comprises a blade body having a blade face and a blade back, with the blade body terminating in a peripheral zone. The propeller also includes blade edge covering members which are releasably securable to at least part of the peripheral zone of the blade so as to cover a radially outer edge of the peripheral zone.

6 Claims, 4 Drawing Sheets

(56) References Cited

U.S. PATENT DOCUMENTS

| | | | | |
|---|---|---|---|---|
| 6,106,235 | A * | 8/2000 | Tettenborn | F04D 29/023 416/213 A |
| 6,644,926 | B1 * | 11/2003 | Vandyke | B63H 1/18 416/228 |
| 7,780,419 | B1 | 8/2010 | Matheny et al. | |
| 7,909,576 | B1 * | 3/2011 | van der Bos | F03D 1/0675 416/146 R |
| 8,491,268 | B2 * | 7/2013 | Chamberlain | B63H 1/18 416/228 |
| 2004/0126242 | A1 | 7/2004 | Howard et al. | |

* cited by examiner

PROPELLER INCLUDING A DISCRETE BLADE EDGE COVER MEMBER

CROSS-REFERENCE TO RELATED APPLICATIONS

This application is the United States national phase of International Application No. PCT/IB2013/056278 filed Jul. 31, 2013, and claims priority to South African Patent Application No. 2012/05753 filed Jul. 31, 2012, the disclosures of which are hereby incorporated in their entirety by reference.

BACKGROUND TO THE INVENTION

THIS invention relates to a propeller and more particularly but not exclusively, to a propeller for use in inboard and outboard boat engines.

A propeller is a device that transmits power by converting rotary motion into thrust. A pressure difference is produced between forward and rear surfaces of the airfoil-shaped blade, and a fluid (such as air or water) is accelerated behind the blade, thus resulting in thrust required to drive a means of transport to which the propeller is attached. One specific type of propeller is a propeller for use as means of propulsion in boat engines, whether outboard or inboard.

Many different propeller designs are known in the trade, and they share many of the same general propeller design characteristics. A propeller comprises a plurality of blades extending radially outwardly from a central rotating hub. Each blade is in the form of an airfoil having two opposite surfaces, being a blade face (which is the pressure side of the blade facing the stern), and the blade back (which is the suction side of the blade facing the bow). Each blade furthermore has a leading edge, which is the edge of the propeller adjacent the forward end of the hub. The leading edge leads the blade into the flow when the propeller is providing forward thrust. The opposing edge is referred to as the trailing edge, and the radially outer zone extending between the leading edge and the trailing edge is referred to as the blade tip. The root of the blade is the fillet area in the region of transition between the blade surface and the hub periphery.

A few other terms that are commonly used in in propeller nomenclature include:

Diameter: Two times the distance from the centre of the hub to the tip of the blade, i.e. equal to the diameter of a circle that the tip of the propeller would make when rotating.

Pitch: Pitch is defined at the theoretical forward movement of a propeller during one revolution, assuming that there is no 'slippage' between the propeller blade and the water. In practice some slippage does occur, and the design pitch is therefore more than the actual pitch.

Cupping: Many existing propellers incorporate a cup formation at the trailing edge of the propeller blade. Propeller cup is the deformation of a propeller's trailing edge toward the pressure face. Cupping provides a measure of camber to the blade, and therefore changes the pressure distribution along the blade's chord length, adding lift toward the trailing edge.

Cavitation: Cavitation, (which is often confused with ventilation), is a phenomena of water vaporizing or "boiling" due to the extreme reduction of pressure on the back of the propeller blade. Many propellers partially cavitate during normal operation, but excessive cavitation can result in physical damage to the propeller's blade surface due to the collapse of microscopic bubbles on the blade. There may be numerous causes of cavitation such as incorrect matching of propeller style to application, incorrect pitch, and physical damage to the blade edges.

Ventilation: Ventilation is a situation where surface air or exhaust gasses are drawn into the propeller blades. When this situation occurs, boat speed is lost and engine RPM climbs rapidly. This can result from excessively tight cornering, a motor that is mounted very high on the transom, or by over-trimming the engine.

Propeller design is mostly dictated by performance criteria, and traditionally safety aspects have not always been a major consideration. One of the major safety considerations is the edge and tip design of the blades, as the edges and tip are the areas that a person can potentially be exposed to during rotation of the propeller. The situation is furthermore often exacerbated when the propeller starts to wear, for example when in use strikes rocks or other hard surfaces, which may render the edge at least partially serrated, thus increasing the safety risk posed by the propeller.

There are a limited number of propeller safety devices available on the market such as for example propeller guards, propeller rings and hydro propulsion drive systems. These retrofit devices are not practical solutions to combat propeller safety, and in addition also adversely affect propeller performance and engine fuel consumption. The safety considerations are therefore often ignored when designing and manufacturing propellers for commercial use, in particular when there is a sacrifice in terms of performance.

It is accordingly an object of the invention to provide a propeller that will at least partially alleviate the above disadvantage.

It is also an object of the invention to provide a propeller having enhanced safety characteristics without adversely affecting the performance of the propeller.

SUMMARY OF THE INVENTION

According to the invention there is provided a propeller including:

a hub;

a plurality of blades extending radially outwardly from the hub, wherein each blade comprises a blade body having a blade face and a blade back, with the blade body terminating in a peripheral zone; and a blade edge covering member which is releasably securable to at least part of the peripheral zone of the blade so as to cover a radially outer edge of the peripheral zone.

The peripheral zone may comprise a leading edge, a trailing edge and a blade tip zone extending between the leading edge and the trailing edge.

There is provided for a first blade edge covering member to be securable to the leading edge.

There is provided for a second blade edge covering member to be securable to the trailing edge.

There is provided for a third blade edge covering member to be securable to the blade tip zone.

Alternatively there is provided for a single blade edge covering member to cover the leading edge and the blade tip zone, the trailing edge and the blade tip zone, or all three zones simultaneously.

There is provided for the blade edge covering member to include a tip section for covering the edge of the peripheral zone, and a lip section extending from the tip section in order for the lip section to overlie at least part of the blade face and/or the blade back.

The lip section may include engagement formations adapted to engage complementary receiving formations provided in the blade body.

The engagement formations provided on the lip section may be in the form of cylindrical protrusions, and the complementary receiving formations may be in the form of apertures provided in the peripheral zone of the blade body.

Preferably, the blade edge covering member includes two opposing lip sections that straddles the blade body in use, with one lip section overlying a peripheral zone of the blade face, and the other lip section overlying a peripheral zone of the blade back.

Engagement formations may extend from both lip sections, and engagement formations extending from one of the lip section may be adapted to engage the engagement formation extending from the other lip section.

There is provided for the blade face and/or the blade back to be at least partially recessed for receiving the lip formation of the blade edge covering member, in order for the lip section to be flush with the blade face and/or blade back when secured to the blade.

The blade edge covering member may comprise two halves, or may alternatively be in the form of a single integrally formed article.

There is provided for the blade edge cover member to be formed from a plastic material. Preferably, the plastic material is a hygroscopic, resilient material.

There is provided for the propeller hub and blades to be integrally formed from magnesium or a magnesium alloy in a moulding process.

The profile of a trailing edge zone of the blade edge covering member may be selected from a range of profiles depending on a required blade pitch.

The width of the blade tip zone of the blade edge covering member may be selected from a range of widths depending on a required blade diameter.

According to a further aspect of the invention there is provided a blade edge covering member suitable for use with a propeller having receiving means suitable for receiving the blade edge cover member.

There is provided for the blade edge covering member to include a tip section for covering an edge of a peripheral zone of the blade, and a lip section extending from the tip section in order for the lip section to overlie at least part of a blade face and/or the blade back of the blade.

The lip section may include engagement formations adapted to engage complementary receiving formations provided in the blade body.

The engagement formations provided on the lip section may be in the form of cylindrical protrusions, and the complementary receiving formations may be in the form of apertures provided in the peripheral zone of the blade body.

Preferably, the blade edge covering member includes two opposing lip sections suitable for straddling the blade body in use, with one lip section overlying a peripheral zone of the blade face, and the other lip section overlying a peripheral zone of the blade back.

Engagement formations may extend from both lip sections, and engagement formations extending from one of the lip section may be adapted to engage the engagement formation extending from the other lip section.

According to a further aspect of the invention there is provided a method of assembling a propeller, the method including the steps of:

providing a propeller body having receiving means provided at edge zones of the blades;

providing at least one blade edge cover member having engagement means adapted to engage the receiving means; and securing the blade edge cover member to the propeller body.

BRIEF DESCRIPTION OF THE DRAWINGS

Two embodiments of the invention are described by way of non-limiting examples, and with reference to the accompanying drawings in which.

DETAILED DESCRIPTION OF INVENTION

Figure 1:
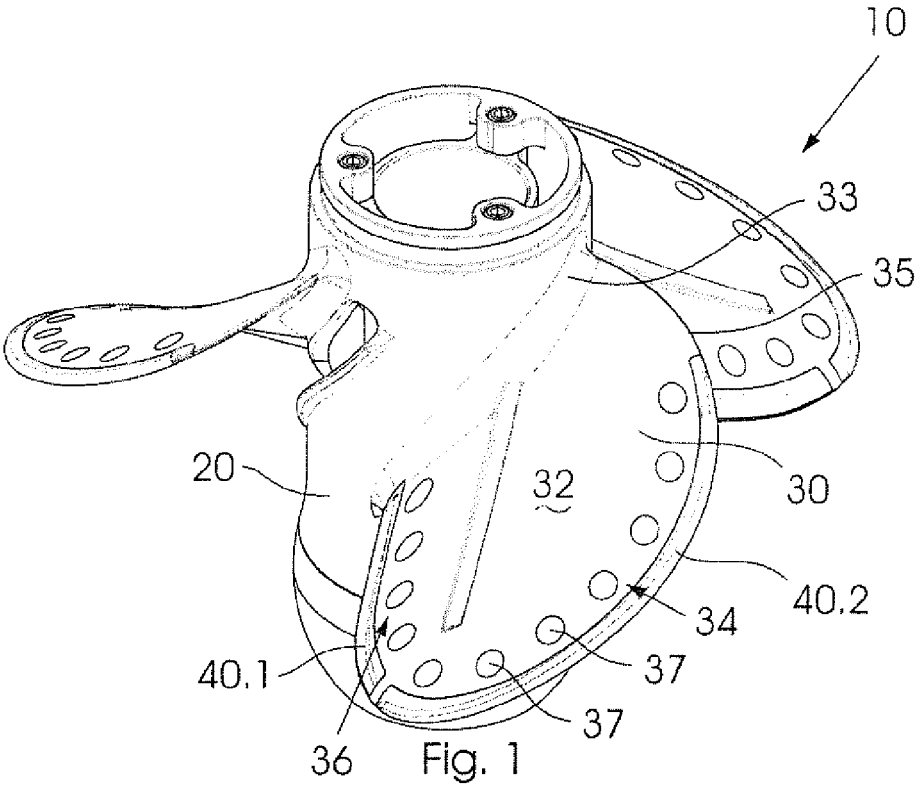
FIG. 1 is a front perspective view of the propeller including two blade edge cover members in accordance with one embodiment of the invention.

Referring to the drawings, in which like numerals indicate like features, a non-limiting example of propeller in accordance with the invention is generally indicated by reference numeral 10.

The propeller 10 comprises a hub 20, which may be of many different configurations. In one embodiment the hub 20 incorporates a secondary propulsion system as described in the applicants co-pending application ZA2012/05757 entitled "Propeller incorporating a secondary propulsion system", the contents of which is incorporated herein by reference. In one embodiment the propeller also includes a flow guide provided on a back face of a blade of the propeller as described in the applicant's co-pending application ZA2012/05758 entitled "Propeller incorporating a blade back flow guide", the content of which is also incorporated herein by reference.

A plurality of blades 30 extend radially outwardly from the hub 20, with each blade being in the form of an airfoil extending from the hub 20 at a root 23 section thereof, and terminating in a peripheral tip zone 34. The blade 30 includes a blade face 31 and a blade back 32. The periphery of the blade 30 comprises a leading edge 35, a trailing edge 36, and an outer tip zone 34 extending between the leading edge 35 and the trailing edge 36.

A plurality of apertures 37 are provided through the blade adjacent the periphery of the blade, and more particularly in an area where an blade edge cover member 40 is to be releasably secured. The combination of apertures 37 to which a sleeve formation 40 is to be secured defines a receiving means of the blade. An edge zone 39 of the blade face may be at least partially recessed in order to receive a lip formation 42 of the blade edge cover member 40 in a substantially flush configuration.

Removable blade edge cover members 40 in the form of plastic moulded bodies are provided. In the embodiment shown in FIGS. 1 to 3 the propeller 10 includes two such edge formations, being a trailing edge blade edge cover member 40.1 and a tip zone blade edge cover member 40.2. In the embodiment shown in FIGS. 4 to 7, a single blade edge cover member 40.3 is provided, and in use covers substantially the entire periphery of the blade.

Each blade edge cover member 40 comprises an arcuate body 41 that follows the profile of the periphery of the blade. The body 41 is made from a flexible hygroscopic material, and an outer edge, or tip section 41.1 of the body is at least partially rounded. A lip formation 42 extends radially inwardly from the body, and is configured and dimensioned to fit inside a recess 39 in an edge zone of the blade, and more particularly in a recess provided in the blade face 31 or the blade back 32 of the blade 30. This means that the edge member will be flush with the remainder of the blade when installed.

Cylindrical protrusions 43 extend upwardly from the lip formation 42, and are configured and dimensioned to fit inside the apertures 37 provided in the edge zone of the blade 30. This enables the blade edge cover member 40 to be removably secured to the blade.

Figure 2:
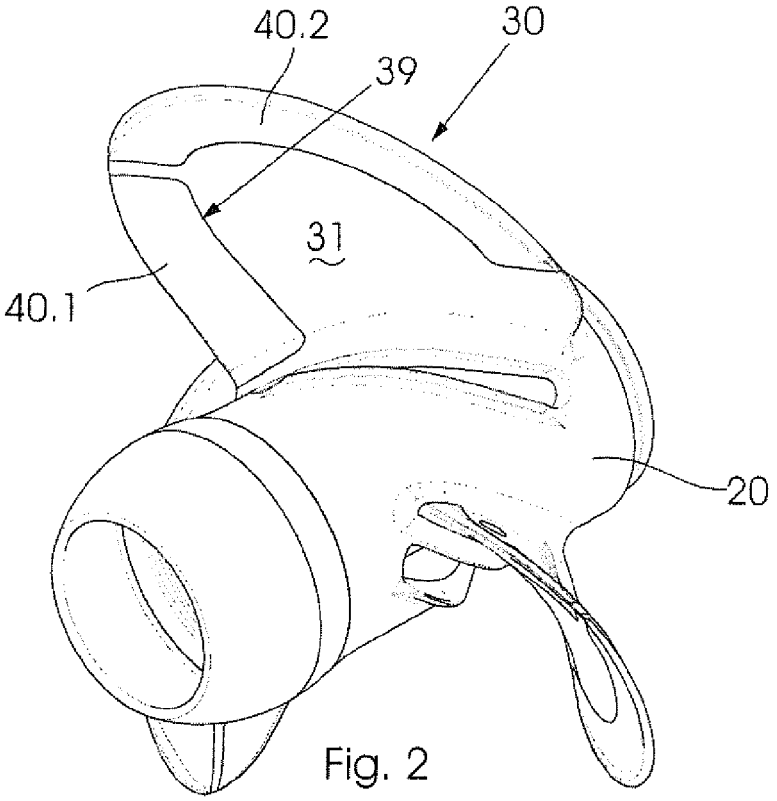
FIG. 2 is rear perspective view of the propeller of FIG. 2.
Figure 3:
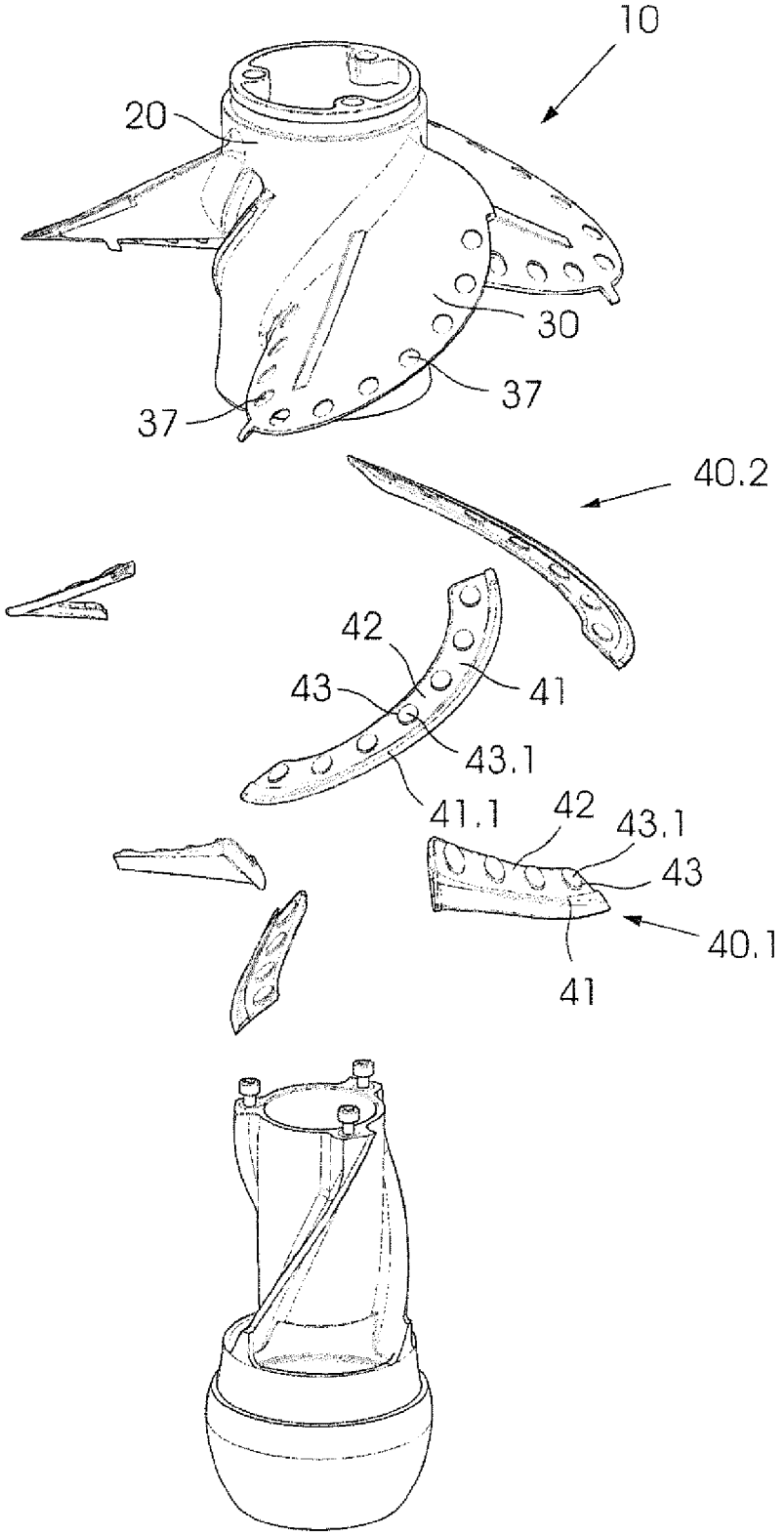
FIG. 3 is an exploded perspective view of the propeller of FIG. 1.
Figure 4:
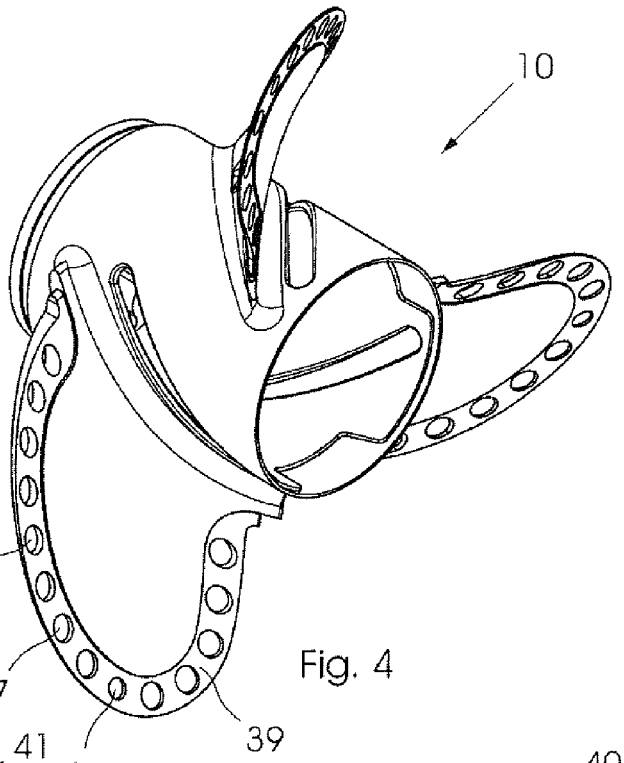
FIG. 4 is a front perspective view of a propeller body suitable for receiving a single blade edge cover member in accordance with another embodiment of the invention.
Figure 5:
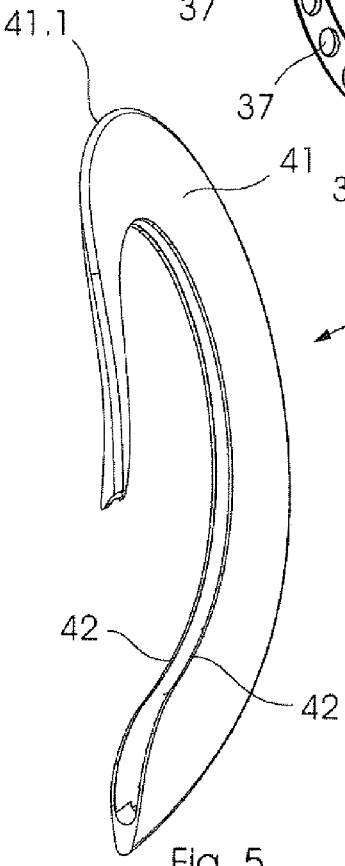
FIG. 5 is a perspective view of the blade edge cover member used in FIG. 4.
Figure 6:
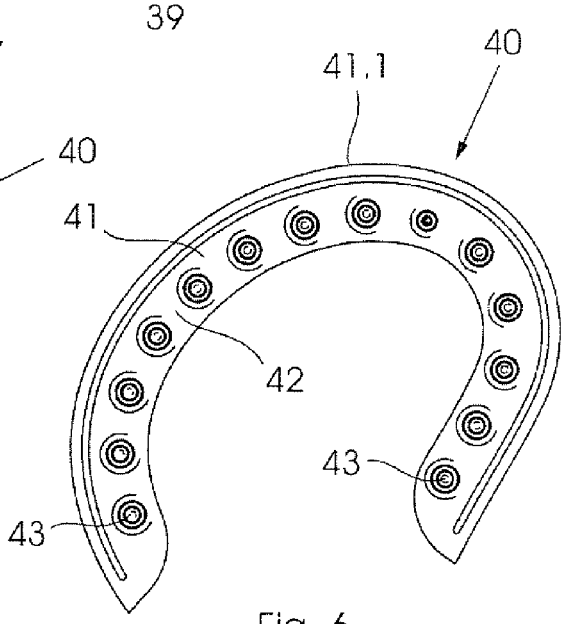
FIG. 6 is a plan view of the blade edge cover member of FIG. 5.
Figure 7:
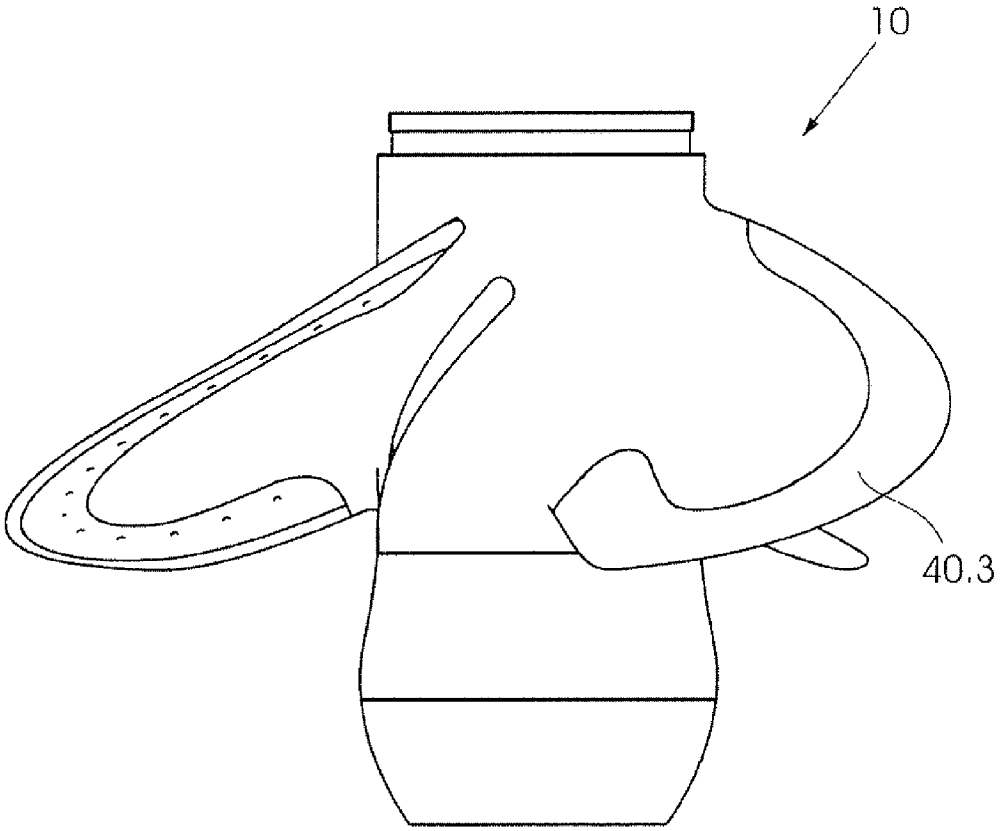
FIG. 7 is a side view of a propeller comprising a propeller body of FIG. 4 fitted with the blade edge cover member of FIG. 5.

In the embodiment shown in FIGS. 1 to 3, the edge cover member 40 only includes one lip section 41, and more particularly only overlies part of the blade face 31. In this embodiment upper surfaces 43.1 of the protrusions are at least partially rounded, and may protrude slightly above the surface of the blade back 32.

In the embodiment shown in FIGS. 4 to 7 the edge cover member 40 includes two opposing lip sections 42, in order for the edge cover member 40 to be adapted, in use, to straddle the peripheral zone of the blade body. In this case recesses 39 will be provided in both the blade face 31 and the blade back 32. In addition, complementary engagement formations 43 will extend from both lip sections towards one another, with opposing engagement formations of the opposing lip sections adapted to engage on another through the apertures 37.

It will appreciated that the propeller may include only a trialing edge blade edge cover member 40.1, alternatively only a tip zone blade edge cover member 40.2, or a single edge cover member 40.3 that covers both the trailing edge and the blade tip. In addition, the same or a further edge cover member may also cover the leading edge of the blade.

The trialing edge blade edge cover member 40.1 may take various configurations, and the cross-sectional profile may be selected in order to selectively adjust the pitch and cupping of the blade. The use of the trialing edge blade edge cover member 40.1 therefore enables the performance of the propeller to be adjustable, and allows the use of one propeller body for a range of different requirement specifications.

The use of the tip zone blade edge cover member 40.2 is first and foremost a safety feature, and the resilient nature and the choice of a hygroscopic material prevents a finger or limb from being drawn into the propeller blades. Also, the tip zone blade edge cover member 40.2 is made from a material that is not prone to wear should the blade hit rocks or other hard materials. Should the blade edge cover member wear, the blade edge cover member can still be replaced without the need to replace the body of the propeller. In addition to the above, tip zone blade edge cover members 40.2 of various widths may be used to alter the effective diameter of the propeller, which again improves the versatility of the propeller.

In the case of the singular edge cover member 40.3, the same design considerations as used for the discrete edge cover members (40.1 and 40.2) can be applied.

The blade edge cover member 40.3 shown in FIGS. 4 to 7 consists of two halves, but may conceivably also be in the form of one integrally formed article.

The propeller 10 body is made from magnesium or a magnesium alloy, which is made in a moulding process known in the art.

It will be appreciated that the above is only one embodiment of the invention and that there may be many variations without departing from the spirit and/or the scope of the invention.

The invention claimed is:

1. A propeller including:

a hub;

a plurality of blades extending radially outwardly from the hub, wherein each blade comprises a blade body having a blade face and a blade back, with the blade body terminating in a peripheral zone; and a blade edge covering member formed from a plastic material which is removably securable to at least part of the peripheral zone of the blade so as to cover an outer edge of the peripheral zone;

wherein the blade edge covering member includes two opposing lip sections that straddle the blade body in use, with one lip section overlying a peripheral zone of the blade face, and the other lip section overlying a peripheral zone of the blade back; and wherein the blade face and the blade back include recessed zones for receiving the lip sections of the blade edge covering member, in order for the lip sections to be flush with the blade face and/or blade back when secured to the blade;

wherein a plurality of apertures are provided through the peripheral zone of the blade; and wherein the lip sections include integral engagement formations in the form of cylindrical protrusions provided on and extending from the lip sections toward one another, with the engagement formations from one of the lip sections adapted to engage the engagement formations provided on the other of the lip sections through the apertures in the blade.

2. The propeller of claim 1, wherein the peripheral zone comprises a leading edge, a trailing edge and a blade tip zone extending between the leading edge and the trailing edge.

3. The propeller of claim 2, wherein a single blade edge covering member covers the leading edge, blade tip zone, and the trailing edge of the blade.

4. The propeller of claim 1, wherein the blade edge covering member is substantially U-shaped in cross-section.

5. The propeller of claim 1, wherein the blade edge covering member comprises two halves, with each half including one of the lip sections.

6. The propeller of claim 1, wherein the blade edge cover member is made from a hygroscopic, resilient plastic material.

* * * * *